United States Patent [19]

Talkington

[11] Patent Number: 5,033,354

[45] Date of Patent: Jul. 23, 1991

[54] DEEP OPERATING MONITOR AND DESTRUCT DEVICE

[75] Inventor: Howard R. Talkington, La Jolla, Calif.

[73] Assignee: The United States of America as represented by the Secretary of the Navy, Washington, D.C.

[21] Appl. No.: 419,152

[22] Filed: Nov. 21, 1973

[51] Int. Cl.[5] ..... F41B 15/00; F42B 20/00

[52] U.S. Cl. ..... 89/1.1; 102/406; 102/413

[58] Field of Search ..... 102/14, 21, 213, 413, 102/501, 406; 89/1 B, 1.1

[56] References Cited

U.S. PATENT DOCUMENTS

| | | | |
|---|---|---|---|
| 3,039,559 | 6/1962 | Ellsworth | 181/142 |
| 3,109,370 | 11/1963 | Elmer et al. | 102/413 |
| 3,134,437 | 5/1964 | Karpovich | 102/213 |
| 3,657,958 | 4/1972 | Well | 89/1.14 |
| 3,665,630 | 5/1972 | Taylor | 89/1.14 |
| 3,712,408 | 1/1973 | Muntz | 181/120 |
| 3,763,738 | 10/1973 | Temple | 89/1.14 |
| 3,782,239 | 1/1974 | Wick | 102/501 |

*Primary Examiner*—David H. Brown

*Attorney, Agent, or Firm*—Harvey Fendelman; Thomas Glenn Keough; William T. Skeer

[57] ABSTRACT

An interdiction system to be placed upon the floor of the ocean includes a target detection and classification system which is cooperatively connected to a hollow enclosure containing a predetermined volume at one atmosphere or less pressure. Upon target aquisition and classification, the detection and classification system actuates a mechanism to rupture the wall of the hollow enclosure. The resultant implosion caused by the ambient ocean pressure creates a high intensity shock wave in the vicinity of the system to damage the intruding vessel.

10 Claims, 1 Drawing Sheet

FIG. 1.
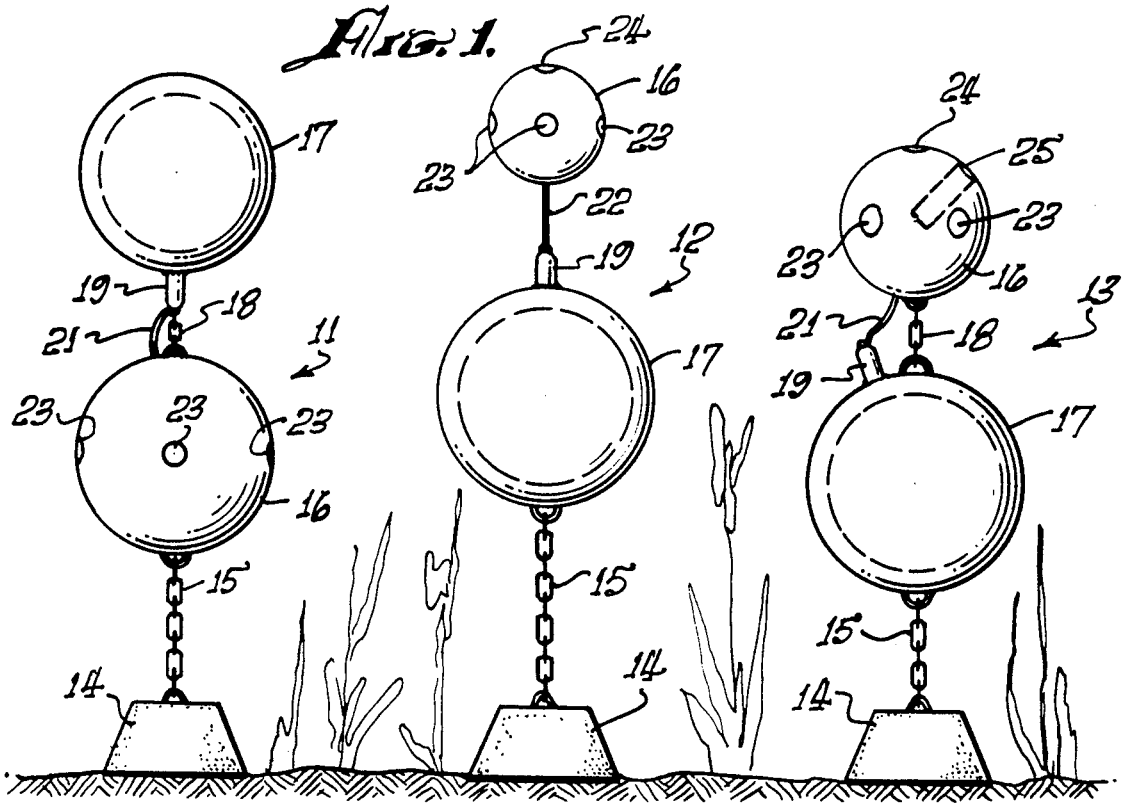
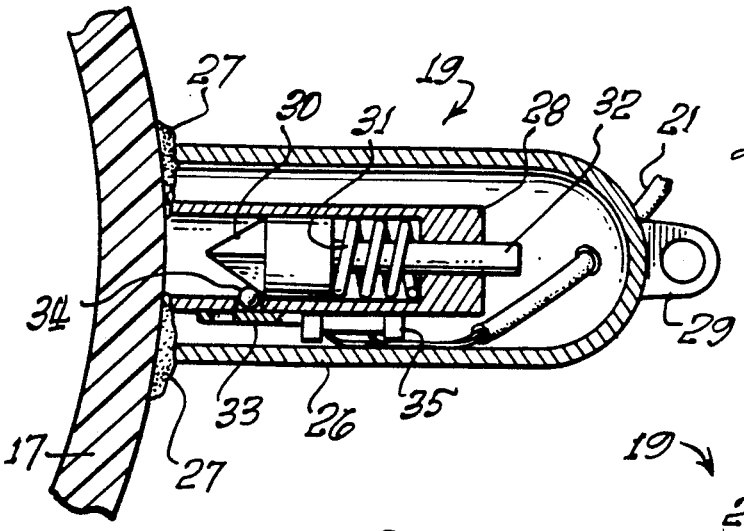
FIG. 2.
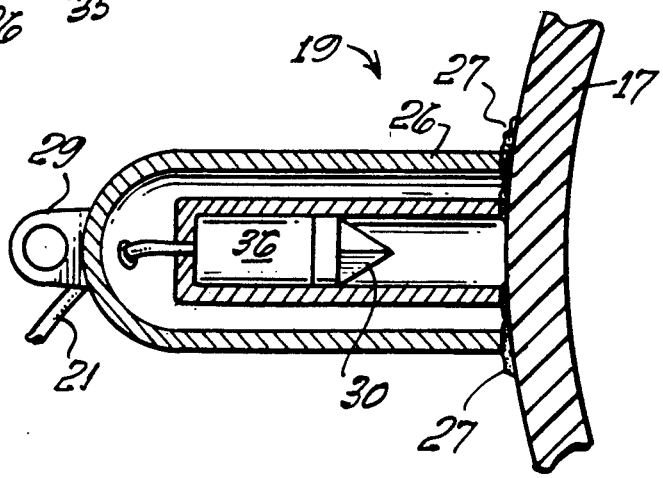
FIG. 3.

DEEP OPERATING MONITOR AND DESTRUCT DEVICE

DESCRIPTION OF THE PRIOR ART

Currently, strategic areas of the sea floor are surveilled by large acoustic arrays which are cable-connected to shore installations. In other situations, certain strategic areas are surveilled by ship sonars or, in some instances, by aerially deployed sonobuoys. When any of these prior art detection systems acquires a target, an aircraft or ship must be deployed to further investigate the target and to deliver a weapon when positive interdiction is desired. These prior art systems, while successfully adapted to protect larger strategically important areas of the ocean floor, do not provide an ideal solution to limited areas. These areas may be beyond the range of the aforedescribed prior art detection systems or occupy a profundity on the ocean floor which is topographically shielded from remote large array surveillance.

The surveillance and interdiction of enemy undersea craft in these localized areas, in the past, have been accomplished by either employing an air drop sonobuoy system and aircraft monitoring thereof, or, in extreme cases, by deploying explosive mines in the near vicinity of the area. The former solution is costly, weather dependent, and suffers from operational complexities. The latter system when warranted in extreme situations, is hazardous to the crews which install the explosive mines and, additionally, presents a threat to future use of the waterways. That is, in time, the explosive mines may be swept away from their anchorages and drift on or near the surface of the sea to remote locations where their presence is unsuspected. To modern mariners, the danger imposed by ordnance devices planted by their forefathers in the naval wars of past generations is so world renown and understood that further elaboration thereon is unwarranted.

SUMMARY OF THE INVENTION

The instant invention overcomes the disadvantages of the prior art by providing a shock wave producing system which is lethal at pelagic depths but relatively harmless in a surface environment. This system employs a frangible wall container having a predetermined volume at low atmospheric pressure which is moored on or near the ocean bottom. A target detection and classification device is attached to the frangible vessel and ruptures it when a predetermined target signal has been acquired and classified. The implosion created by rupturing the frangible wall vessel at these great depths produces a shock wave capable of general and localized damage to the highly stressed hulls of naval vessels operating at these depths.

STATEMENT OF GOVERNMENT INTEREST

Accordingly, it is an object of this invention to provide an improved underwater interdiction system.

Another object of the present invention is to provide an underwater interdiction system for deep ocean environments.

Yet another object of the present invention is to provide an underwater interdiction system for deep ocean environments which may be safely handled and transported on the surface.

Still another object of the invention is to provide an underwater monitor and destruct system to prevent submarine vessel intrusion into a predetermined area.

Another object of the present invention is to provide an underwater monitor and destruct system employing implosion of a predetermined volume of low pressure gas.

Yet another object of the present invention is to provide an underwater marine line system without the use of high explosives.

These and other objects of the invention will become more readily apparent from the ensuing specification when taken with the drawings.

BRIEF DESCRIPTION OF THE DRAWINGS

FIG. 1 is an elevational view of the invention installed on the ocean floor;

FIG. 2 is a longitudinal view of the apparatus used to initiate the destructive implosion; and FIG. 3 is a similar longitudinal view of another form of the same mechanism illustrated in FIG. 2.

DESCRIPTION OF THE PREFERRED EMBODIMENTS

Referring to FIG. 1 an elevational view of an area for which interdiction of submarine vehicles is desired is illustrated. Three interdiction systems according to the invention are indicated generally at 11, 12, and 13.

As illustrated with reference to system 11, an anchor 14 has a mooring chain 15 attached thereto to support a positively buoyant detection unit 16. Anchor 14 may be made of any suitable weighted material such as, for example, steel, lead, or concrete. Similarly, mooring chain 15 is illustrated as comprising a plurality of interfitting links, however, if desired, a flexible continuous filament line may be employed for this purpose.

Detection unit 16 may be conventional marine mine detection mechanism. For example, if magnetic detection is desired, the devices disclosed in U.S. Pat. Nos. 3,015,273 and 3,017,834 to R. H. Park et al issued on Jan. 2, 1962 and Jan. 23, 1962, respectively, may be employed successfully in the system of the invention. Similarly, conventional acoustic detection in arrangements are possible and may, for example, employ the system disclosed and described in U.S. Pat. No. 3,444,508 to E. A. Granfors et al issued on May 15, 1969.

In the arrangement of system 11, it is unnecessary that detection and classification unit 16 be positively buoyant since buoyancy may be supplied by a spherical vessel 17, to be further described herein.

A plurality of transducers 23 are spaced about the outer surface of detection unit 16. If an acoustic system is used for detection and classification of the approaching underwater vessel, transducers 23 may be of the type described in U.S. Pat. No. 3,470,394 granted on Sept. 30, 1969 to Rufus L. Cook et al which is incorporated herein. Further, to improve watertight integrity at the high ambient pressures of pelagic depths the transducers may be curved to conform with the exterior of the casing of detection unit 16 by employing the technique for curving piezoelectric ceramics disclosed in the U.S. Pat. No. 3,496,617 granted Feb. 24, 1970 to Rufus L. Cook et al, similarly incorporated herein.

Classification and detection unit 16 is connected to spherical vessel 17 which contains air or other gas at one atmosphere or lower pressure and is vertically disposed with relation to detection unit 16 by virtue of relative buoyancy between the units. Spherical vessel 17 has walls constructed of a frangible material. The two units are tethered together by means of a suitable flexible tether 18. Tether 18 extends from detection unit 16 and attaches to a pertusion unit 19, to be more completely described herein. Pertusion unit 19 is operationally connected to detection unit 16 by means of a suitable underwater electrical cable 21. Like chain 15, tether 18 may be comprised of a metallic link chain or other suitable flexible conduit.

The hollow frangible sphere 17 may be of any suitable frangible material configured to withstand the high ambient pressures associated with deep sea applications. However, for purposes of illustrative clarity, it should be noted that the acrylic spherical plastic shells currently employed in undersea applications have proven satisfactory in developmental models. For a complete discussion of the characteristics and fabrication techniques for such structures, Technical Report R-676 entitled, "Development of a Spherical Acrylic Plastic Pressure Hull for Hydrospace Applications" published by the Naval Civil Engineering Laboratory, Port Hueneme, Calif., in April 1970 (copies available at the Clearinghouse for Federal Scientific and Technical Information, Sills Building, 5285 Port Royal Road, Springfield, Va. is referenced.

The arrangement of the invention indicated at 12 differs somewhat from that shown at 11. As will be noted the hollow frangible shell 17 is positioned below detection unit 16. Of course, this requires that detection unit 16 be positively buoyant so as to float above shell 17. This arrangement has the advantage of permitting an additional transducer, indicated at 24, to be positioned on the upper surface of detection unit 16 to monitor ship intrusions in the hydrospace located above detection unit 16. Of course, transducer 24 may be of the same type as transducers 23 and, as conventional in the art, connected into a transducer system.

It will also be noted that interdiction system 12 employs electrical cable 22 connected between detection classification units 16 and pertusion device 19 to provide the flexible tether therebetween. Of course, such a cable requires tension transmitting members including therein as well as the electrical conducting members. Such cable constructions are well known in the underwater acoustic arts and an example thereof is disclosed in U.S. Pat. No. 3,458,855 granted to Albert E. Wallen on July 29, 1969.

Similar to interdiction system 12, interdiction system 13 positions detection unit 16 above frangible hollow sphere 17. Like interdiction system 11, interdiction system 13 employs a separate tether chain 18 and flexible electrical conductor 21 to interconnect detection unit 16 with frangible sphere 17 and protrusion device 19. Additionally, detection system 16 incorporates a releasable marker 25 which may be squib fired to release at the same instant that pertusion device 19 is triggered. An example of a suitable marker device is to be found in U.S. Pat. No. 3,702,014 issued on Nov. 7, 1972 to James L. Rabon et al. It should be noted, however, that for extreme depths, an anchor need not be used on the marker device.

Referring to FIG. 2, a sectional view of the pertusion device 19 is illustrated. Device 19 includes a hollow shell 26 which is held to the exterior of frangible vessel 17 by means of a epoxy cement illustrated at 27. This cement fastening covers an area on the exterior surface of frangible shell 17 and also supports a barrel 28 having an open end adjacent the exterior surface of frangible shell 17. A pointed tool 30 is slidably retained in barrel 28 and is urged into contact with frangible shell 17 by means of a spring 31. Tool 30 is held in a cocked position by means of a ball 34 which cooperates with a slide 33 operated by means of a solenoid 35 which is operationally connected via conductor 21 to detection and classification unit 16. Tool 30 is guided within a barrel 28 by means of a cylindrical extension 32 extending rearwardly therefrom to pass through a guiding aperture in the back of barrel 28.

Thus when solenoid 35 is energized slide 33 is withdrawn such that ball 34 is pushed through a hole in barrel 28 and tool 30 is driven forward by spring 31 to rupture the wall of frangible vessel 17. To facilitate this penetration the tip of tool 30 may be made of a hardened substance such as carborundum.

A mounting ring 29 is attached to the back of housing 26 of pertusion device 19 to facilitate attachment of tether 18 or for the tension member portion of conductor 22. Housing 19 may be made of a thin wall metallic material or a suitable high strength thermal plastic material.

Referring to FIG. 3 an alternate arrangement of pertusion device 19 is illustrated, as shown, from that of FIG. 2 in the fact that barrel 28 is closed on the rear end and contains an explosive squib 26 which drives tool 30 into the external wall of frangible vessel 17 upon electrical actuation by signals transmitted by electrical conductor 21. Such explosive squibs are well understood in the marine and naval engineering arts and are illustrated in the aforereferenced patent to James L. Rabon et al.

The foregoing description taken together with the appended claims constitute a disclosure such as to enable a person skilled in the marine engineering and oceanographic arts and having the benefit of the teaching as contained therein to make and use the invention. Further, the structure herein described meets the objects of invention, and generally constitutes a meritorious advance in the art unobvious to such a skilled worker not having the benefit of the teachings contained herein.

Obviously, many modifications and variations of the present invention are possible in the light of the above teachings, and, it is therefore understood that within the scope of the disclosed inventive concept, the invention may be practiced otherwise than specifically described.

What is claimed is:

1. An interdiction system for preventing intrusion into a predetermined underwater area comprising:

anchor means for determining a fixed position on the floor of the ocean;

detection means effectively attached to said anchor means for buoyant support in fixed relation thereto;

frangible vessel means containing a volume of low-pressure gas and effectively attached to said anchor means and to said detection means for maintaining a volume at low atmospheric pressure in said underwater area; and pertusion means physically attached to said frangible vessel means in engaging relation therewith and operationally connected to said detection means to be actuated thereby for destructively penetrating said frangible vessel, such that the ambient pressure surrounding the interdiction system produces an underwater implosion in the underwater area at the fixed position.

2. An interdiction system according to claim 1 in which said detection means and said frangible vessel means are connected together by means of a flexible tether, and, in turn, one of these connected means is connected to said anchor means to form a three-part assembly.

3. An interdiction system according to claim 2 in which said frangible vessel means is the center member of the three-part assembly.

4. An interdiction system according to claim 1 in which said pertusion means comprises a pointed tool slidably retained in a cylindrical barrel in cooperative relation with said frangible vessel means so as to permit driving the tool into the exterior wall thereof.

5. An interdiction system according to claim 4 in which said pertusion means includes a spring driving member.

6. An interdiction system according to claim 5 in which said pertusion means is electrically actuated.

7. An interdiction system according to claim 1 in which said frangible vessel means comprises a spherically shaped enclosure of one atmospheric pressure.

8. An interdiction system according to claim 7 in which said pertusion means comprises a pointed tool slidably retained in a cylindrical barrel in cooperative relation with said frangible vessel means so as to permit driving the tool into the exterior wall thereof.

9. An interdiction system according to claim 8 in which said pertusion means includes a spring driving member.

10. An interdiction system according to claim 9 in which said pertusion means is electrically actuated.

* * * * *